US006027370A

United States Patent [19]

Hsu et al.

[11] Patent Number: 6,027,370

[45] **Date of Patent: *Feb. 22, 2000**

[54] MECHANISM FOR ARRANGING DIFFERENT I/O CONNECTORS

[75] Inventors: Susan Hsu, Hsin-Chu Hsian, Taiwan; Chang-Xiu Du, Shi-An, China; Ziqiang Zhu, Jin-Tang, China; Liang Gong, Shin-Iu, China

[73] Assignee: Hon Hai Precision Ind. Co., Ltd., Taipei Hsien, Taiwan

[ * ] Notice: This patent is subject to a terminal disclaimer.

[21] Appl. No.: 09/139,884

[22] Filed: Aug. 25, 1998

[30] Foreign Application Priority Data

Aug. 27, 1997 [TW] Taiwan ..... 86214763

[51] Int. Cl.[7] ..... H01R 13/66

[52] U.S. Cl. ..... 439/541.5

[58] Field of Search ..... 439/541.5, 607, 439/540, 701, 540.1, 79

[56] References Cited

U.S. PATENT DOCUMENTS 5,800,207 9/1998 Hsu et al. ..... 439/541.5

*Primary Examiner*—Lincoln Donovan
*Assistant Examiner*—Eugene G. Byrd
*Attorney, Agent, or Firm*—Wei Te Chung

[57] ABSTRACT

An electrical connector module comprises an insulative bracket, three connectors of different dimension, and a number of positioning devices. The bracket is formed to have an elongate main body with a pair of upper locking seats extending upward from opposite ends thereof and three lower locking seats extending downward from left, central, and right portions thereof, respectively. The connector having the largest dimension is positioned on the main body of the bracket between the pair of upper locking seats and is secured thereto by some of the positioning devices which also retain the connector on a printed circuit board. The remaining two connectors are positioned within a space defined between the left lower locking seat and the central lower locking seat, and the right lower locking seat and the central lower locking seat, respectively. The remainder of the positioning devices are used to secure the connectors to the bracket and the PCB.

21 Claims, 3 Drawing Sheets

MECHANISM FOR ARRANGING DIFFERENT I/O CONNECTORS

BACKGROUND OF THE INVENTION

1. Field of the Invention

The present invention relates to a mechanism for arranging different types of connectors, and particularly to an insulative bracket which arranges connectors of different dimension at different levels for effectively conserving space within a computer housing.

2. The Prior Art

The trend of the computer industry is to create products having an increased speed of signal transmission and a compact size while maintaining a high level of performance. To meet this trend, single electrical connectors are combined in modules on a mother board disposed within a computer housing, whereby electrical components on the mother board can be more compactly arranged thereon.

Computers commonly employ more than one D-sub connector for use as I/O connectors. The D-sub connectors usually include nine, fifteen, or twenty-five signal transmission pins corresponding to different applications and each connector is mounted on a rear portion of the mother board adjacent to a rear panel of the computer housing thereby occupying a significant amount of space on the mother board. In addition, the installation of additional connectors onto the mother board becomes difficult.

U.S. Pat. Nos. 5,037,330, 5,080,609, 5,336,109, 5,401,192, and 5,407,336 each disclose module connectors which combine connectors together for reducing occupied space on the mother board. However, since many peripheral devices are connected to the computer at the rear portion of the mother board, such conventional module connectors cannot successfully meet the requirements.

U.S. Pat. No. 5,800,207, which is assigned to the same assignee as the present invention, discloses a bracket for combining three D-sub connectors of different dimension into one connector module. The two smaller connectors are located below the larger connector but are not secured to the bracket to allow for variations in arrangement which require the lower connectors to be replaced with other electrical components which are directly soldered to the mother board. However, the majority of applications for the bracket do not utilize such additional electrical components.

Hence, an improved mechanism for combining several electrical connectors together to form a connector module is needed to eliminate the above mentioned defects of the prior art.

SUMMARY OF THE INVENTION

Accordingly, an objective of the present invention is to provide a mechanism for combining three electrical connectors into a connector module having an arrangement which significantly reduces the space occupied by the connectors on a mother board.

Another objective of the present invention is to provide a mechanism for combining three electrical connectors into a connector module which is easy to assemble.

According to an aspect of the present invention, an electrical connector module comprises an insulative bracket, three D-sub connectors of different dimension, and a number of positioning devices including first board locks, second board locks, and rivets. The bracket is formed to have an elongate main body with a pair of upper locking seats extending upward from opposite ends thereof and three lower locking seats extending downward from left, central, and right portions thereof, respectively. A guiding seat is formed adjacent to a rear portion of each upper locking seat. Each guiding seat defines a slot therethrough for receiving an engagement portion of the corresponding first board lock.

In assembly, the connector having the largest dimension is positioned on the main body of the bracket between the pair of upper locking seats. Rivets are inserted through aligned holes of the first board locks, the locking seats, and the largest connector from a rear portion of the bracket. The second board locks are positioned between the lower locking seats and the two remaining connectors. Rivets are inserted from the rear portion of the bracket through aligned holes of the lower locking seats, the second board locks, and the connectors. Thus, the connectors are firmly attached to the bracket and the connector module can be mounted to the printed circuit board by means of the positioning devices.

These and additional objectives, features, and advantages of the present invention will become apparent after reading the following detailed description of the preferred embodiment of the invention taken in conjunction with the appended drawings.

DETAILED DESCRIPTION OF THE PREFERRED EMBODIMENT

Reference will now be made in detail with regard to the preferred embodiment of the present invention.

Figure 1:
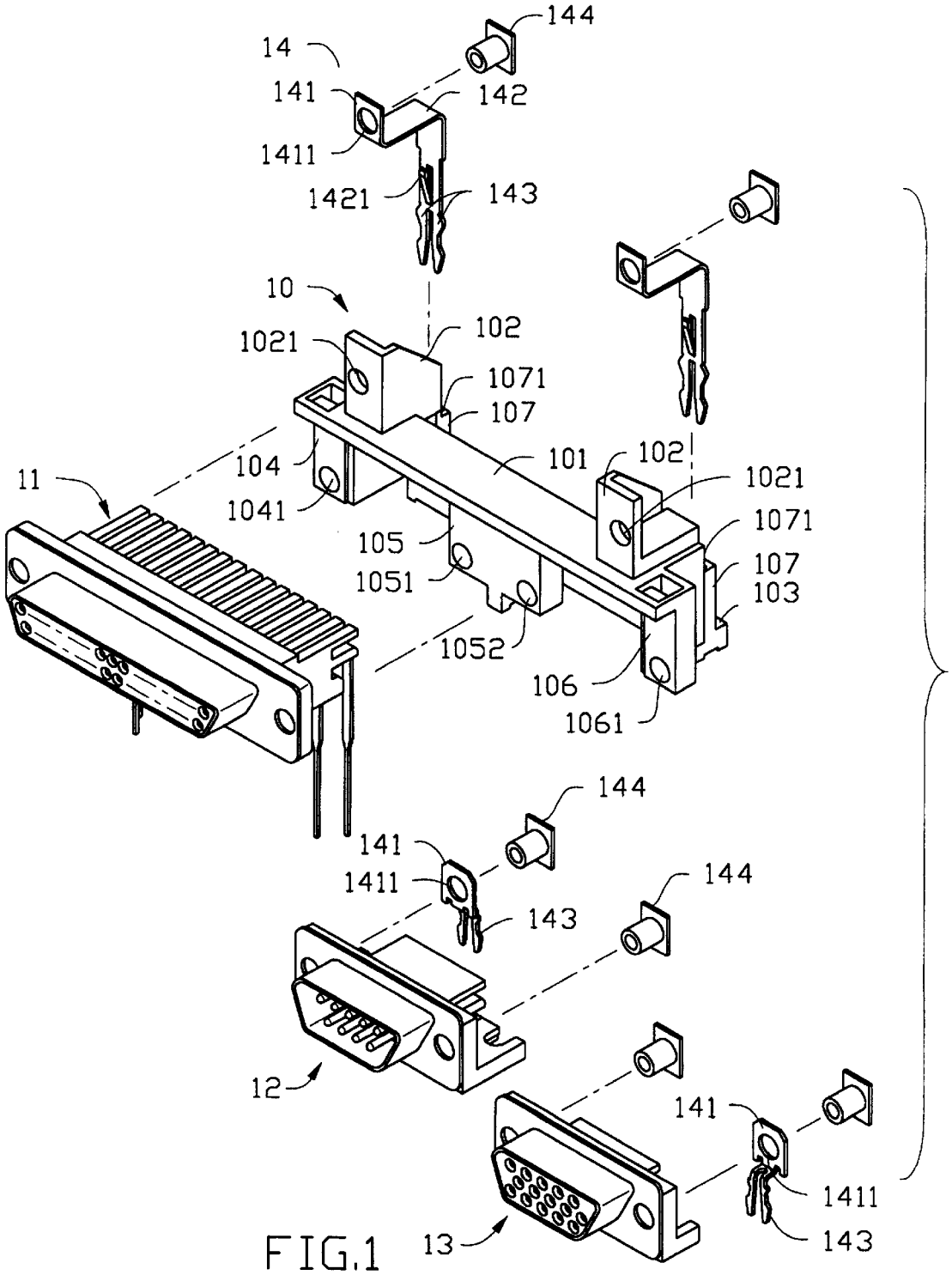
FIG. 1 is an exploded view of a bracket, three connectors to be combined thereby, and a number of positioning devices in accordance with the present invention.

Referring to FIG. 1, an electrical connector module 1 comprises an insulative bracket 10, a first connector 11, a second connector 12, a third connector 13, and a number of positioning devices 14. The first connector 11 is a twenty-five pin D-sub connector, the second connector 12 is a nine pin D-sub connector, and the third connector 13 is a fifteen pin D-sub connector. The positioning devices 14 include first board locks 140, second board locks 141, and rivets 144.

The bracket 10 is formed to have an elongate main body 101 with a pair of upper locking seats 102 extending upward from opposite ends thereof and three lower locking seats 104, 105, 106 extending downward from left, central, and right portions thereof, respectively. A spacer plate 103 for receiving a plurality of contact tail portions of the first connector 11 is integrally formed between rear portions of the outermost lower locking seats 104, 106 wherein a rear portion of the central lower locking seat 105 is also connected thereto. A guiding seat 107 is formed between each locking seat 102 and the spacer plate 103. Each guiding seat defines a slot 1071 therethrough for receiving an engagement portion 145 of the corresponding first board lock 140. Each locking seat 102, 104, 106 defines a hole 1021, 1041, 1061 through front and rear faces thereof except for the central lower locking seat 105 which defines a pair of holes 1051, 1052 therethrough.

Each first board lock 140 includes an L-shaped mating face 142 defining a hole 1420 in a front face 1421 thereof and the engagement portion 145 extends downward from the mating face 142. The engagement portion 145 forms an upwardly protruding tang 1451 for providing a secure engagement within the corresponding slot 1071 of the guiding seat 107, and a bifurcated free end 1452 forming a pair of protrusions 1453 extending from each side thereof for facilitating insertion and stable retention of the first board lock 140 on a related printed circuit board (not shown). Each second board lock 141 includes a mating face 146 defining a hole 1461 therein and a bifurcated engagement portion 147 extending from the mating face 146 for attachment to the PCB. The engagement portion 147 of the second board lock 141 forms a pair of protrusions 1472 on each side thereof for ensuring stable retention of the second board lock 141 on the PCB.

In assembly, the first connector 11 is positioned on the main body 101 of the bracket 10 between the pair of upper locking seats 102 whereby holes 111 defined in a shell 112 thereof are aligned with the corresponding holes 1021 of the upper locking seats 102. The engagement portions 145 of the first board locks 140 are inserted into the corresponding slots 1071 of the guiding seats 107 whereby the mating faces 142 of the first board locks 140 abut against inner surfaces (not labeled) of the upper locking seats 102. The holes 1420 of the first board locks 140 align with the holes 1021 of the upper locking seats 102 and the holes 111 of the first connector 11 whereby the rivets 144 can be serially inserted through the holes 1420, 1021, 111 from a rear portion of the bracket 10 to firmly secure the first connector 11 thereto.

Figure 2:
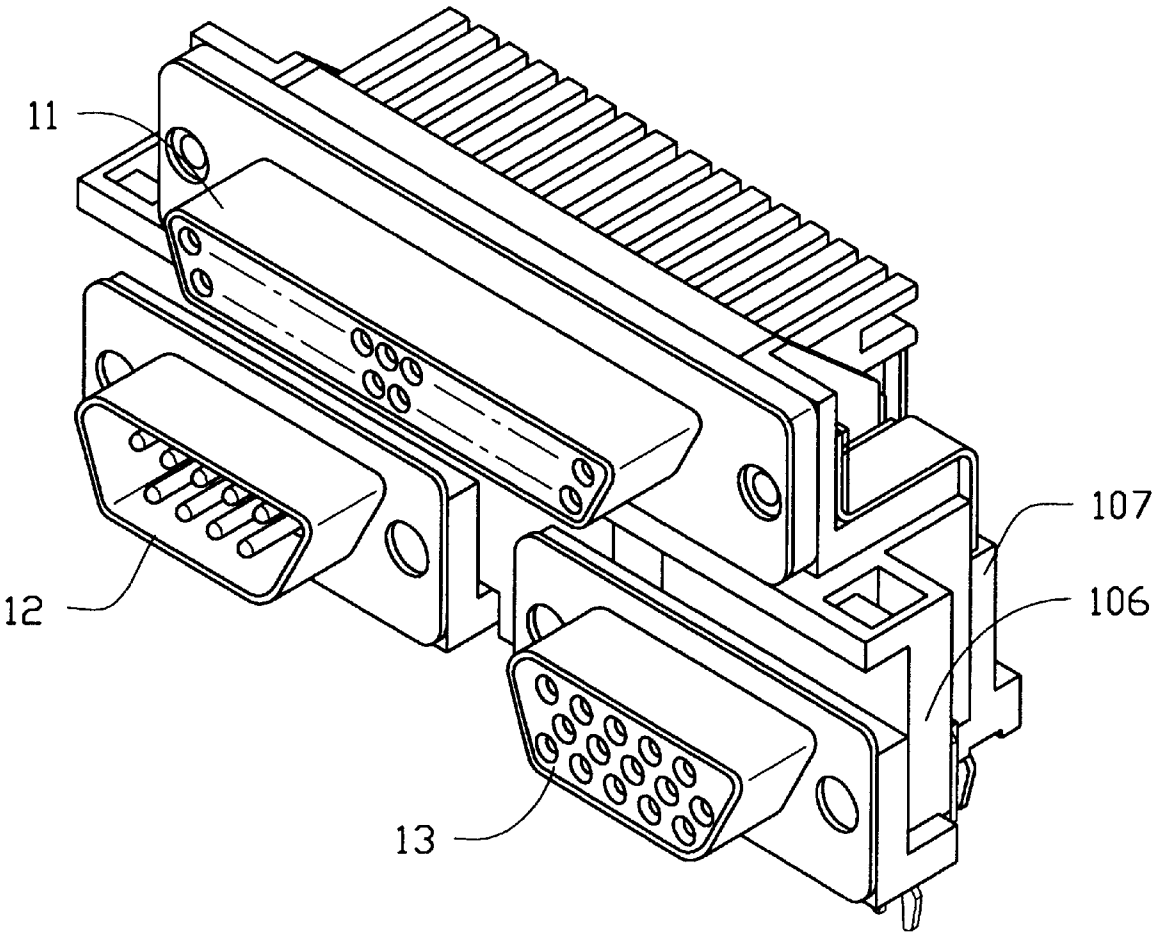
FIG. 2 is an assembled view of FIG. 1.
Figure 3:
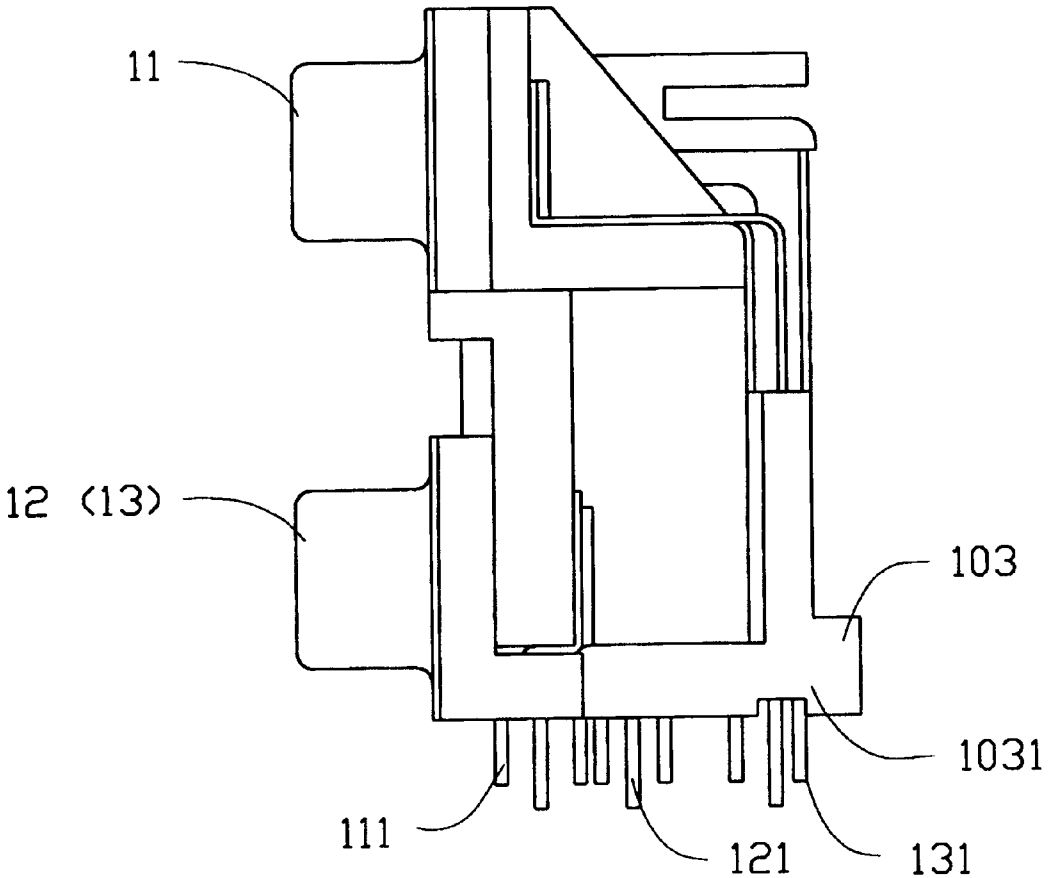
FIG. 3 is a side, elevational view of FIG. 2.

A pair of the second board locks 141 are each attached to the second connector 12 and the third connector 13 by positioning the mating face 146 of each second board lock 141 against a rear surface (not labeled) of the corresponding connector 12, 13 whereby the holes 1461 of the second board locks align with holes 121, 131 defined in a shell 122, 132 of each connector 12, 13. The second connector 12 is positioned within a space defined between the left lower locking seat 104 and the central lower locking seat 105, and the third connector 13 is positioned within a space defined between the right lower locking seat 106 and the central lower locking seat 105. Four of the rivets 144 are then respectively inserted from the rear portion of the bracket 10 through the holes 1041, 1051, 1052, 1061 of the lower locking seats 104, 105, 106, the holes 1461 of the second board locks 141, and the holes 121, 131 of the second and third connectors 12, 13 for firmly attaching the second and third connectors 12, 13 to the bracket 10 as shown in FIGS. 2 and 3.

From the above description, it can clearly be seen that three connectors of different dimension are easily combined in a connector module whereby space on a mother board can be effectively conserved.

It can be noted that the invention and the aforementioned U.S. Pat. No. 5,800,207 are both intended to efficiently arrange a larger connector and two small connectors on a mother board. In comparison with the '207 patent which only configures the disposition of these three connector but fails to integrate these three connectors with the bracket, the invention further arranges these three connector to be combined as one piece through the associated bracket, thus making it easier for the computer manufacturer to directly mount these integral unit to the mother board. It is also seen that the pair of locking seats 102 provides a larger upward space therebetween for allowing the larger connector 11 to be installed into, from the top, and received within the larger space. In opposite, the locking seats 104, 105, and 106 defines two separate downward smaller spaces for respectively receiving two individual smaller connectors 12 and 13.

Moreover, a pair of locking holes 1021 are respective provided on the corresponding locking seats 102 by two sides of such larger space to cooperate with the aligned corresponding holes of the connector 11 and commonly be fastened together by means of a rivet 144. Different from the free disposition of the connector disclosed in the previous U.S. Pat. No. 5,800,207, the connectors 12 and 13 of the invention require some different arrangements on the bracket in comparison with those in the previous patent. That is, the bracket 10 has two pairs of locking holes 1041, 1051 and 1061 by two sides of smaller spaces, respectively, on the lower portion thereof for alignment with the corresponding holes of the connectors 12 and 13 in a front-to-end direction so as to be easily fastened with each other by means of the rivets 144.

In conclusion, the invention provides a structure arrangement for integrating one larger connector at the upper lever and two separate smaller connectors side by side at the lower lever by means of a frame or bracket wherein each connector can be fastened to the bracket through the original holes in the connector by means of a rivet which is also originally used with the connector. No additional structure different from the original configuration of the connector is required. It is an economic, reliable and convenient arrangement of the connector assembly for use with the mother board.

While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. An electrical connector module mounted on a printed circuit board, comprising:

an insulative bracket having an elongate main body with a pair of upper locking seats extending upward from opposite ends thereof and three lower locking seats extending downward from left, central, and right portions thereof, respectively;

a first connector secured to the bracket between the two upper locking seats;

a second connector secured to the bracket between the left and central lower locking seats; and a third connector secured to the bracket between the right and central lower locking seats.

2. The module as described in claim 1, wherein each locking seat defines a first hole through front and rear faces thereof except for the central lower locking seat which defines a pair of first holes therethrough and each connector defines a pair of second holes in distal ends of a shell thereof in alignment with the first holes.

3. The module as described in claim 2, wherein a guiding seat is formed adjacent to a rear portion of each upper locking seat, each guiding seat defining a slot therethrough.

4. The module as described in claim 3 further comprising positioning devices for attaching the connectors to the bracket and securing the module onto the printed circuit board, the positioning devices including first board locks for engagement with the upper locking seats, second board locks for engagement with the lower locking seats, and a number of rivets for securing the board locks and the connectors to the corresponding locking seats.

5. The module as described in claim 4, wherein each board lock forms a mating face with a third hole defined therein in alignment with the first and second holes of the corresponding locking seats and connectors, and an engagement portion extending downward from the mating face for engagement with the printed circuit board.

6. The module as described in claim 5, wherein the mating face of the first board lock confronts an inner surface of the corresponding upper locking seat, the engagement portion of the first board lock is interferentially received in the corresponding slot of the guiding seat, and one of the rivets is serially inserted through the corresponding third, first, and second holes from a rear portion of the bracket.

7. The module as described in claim 5, wherein the third holes of the second board locks are aligned between the second holes of the corresponding second and third connectors and the first holes of the lower locking seats, and one of the rivets is serially inserted through the corresponding first, third, and second holes from the rear portion of the bracket.

8. The module as described in claim 1, wherein the first connector has a significantly larger dimension than the second and third connectors.

9. An insulative bracket for efficiently mounting electrical connectors on a printed circuit board, comprising an elongate main body with a pair of upper locking seats extending upward from opposite ends thereof and three lower locking seats extending downward from left, central, and right portions thereof, respectively;

wherein a first connector is secured to the bracket between the two upper locking seats, a second connector is secured to the bracket between the left and central lower locking seats, and a third connector is secured to the bracket between the right and central lower locking seats.

10. The bracket as described in claim 9, wherein each locking seat defines a first hole through front and rear faces thereof except for the central lower locking seat which defines a pair of first holes therethrough, each first hole aligning with second holes of the corresponding connectors and third holes of corresponding board locks.

11. The bracket as described in claim 10, wherein rivets are inserted through the aligned holes to attach the connectors and board locks to the corresponding locking seats.

12. The bracket as described in claim 10, wherein a guiding seat is formed adjacent to a rear portion of each upper locking seat, each guiding seat defining a slot therethrough for receiving engagement portions of the corresponding board locks.

13. The bracket as described in claim 9, wherein a spacer plate for receiving a plurality of contact tail portions of the first connector is integrally formed between rear portions of the left and right lower locking seats, and a rear portion of the central lower locking seat is also connected thereto.

14. An electrical connector module mounted on a printed circuit board, comprising an insulative bracket having an elongate main body with a pair of upper locking seats extending upward from opposite ends thereof and firmly attaching an upper connector above the main body by means of a pair of first positioning members, and a plurality of lower locking seats extending downward from said main body and firmly attaching at least a lower connector below said main body by means of a pair of second positioning members.

15. The module as described in claim 14, wherein a spacer plate for receiving a pair of first board locks which are respectively attached with said upper connector and said upper locking seats by the first positioning members for securing the module onto the printed circuit board.

16. The module as described in claim 14, wherein a pair of second board locks are respectively attached with said lower connector and said lower locking seats by the second positioning members for securing the module onto the printed circuit board.

17. The module as described in claim 14, wherein each positioning member consists of a through hole defined in the respective locking means and a rivet.

18. A connector assembly including:

a bracket defining an upper larger space at an upper level and two separate side-by-side smaller spaces at a lower level;

a larger connector being received in said larger space;

two smaller connectors being received in said two smaller spaces, respectively;

a first pair of locking holes disposed by two sides of the larger space, and two second pairs of locking holes respectively disposed by two sides of the smaller spaces; wherein the first pair of locking holes are aligned with corresponding holes in the larger connector in a front-to-end direction, and the second pairs of locking holes are respectively aligned with corresponding holes in the smaller connectors in the front-to-end direction so that the larger and smaller connectors can be fastened to the bracket by a plurality of corresponding rivets extending through the locking holes of the bracket and the corresponding holes of the connectors in the front-to-end direction.

19. The assembly as described in claim 18, wherein the bracket defines a left locking seat section, a right locking seat section and a central locking seat section therebetween wherein each of the left locking seat section and the right locking seat section includes one locking hole while the central locking seat section includes two locking holes respectively corresponding to each of said two smaller spaced by two sides.

20. A bracket for combining a larger connector and two smaller connectors together, comprising:

a larger space defined at an upper level and two smaller side-by-side spaces at a lower level;

a first pair of locking holes respectively extending in a front-to-end direction by two sides of the larger space;

two second pairs of locking holes each pair respectively positioned by two sides of the corresponding smaller space and extending in the front-to-end direction.

21. The bracket as described in claim 20, wherein the larger space is defined between two locking seat sections and directed upward, while each of the smaller spaces is defined between two locking seat sections and directed downward.

* * * * *